US007971271B2

(12) United States Patent
Raghuprasad

(10) Patent No.: US 7,971,271 B2
(45) Date of Patent: Jul. 5, 2011

(54) TREE CLIMBING SUIT

(76) Inventor: Puthalath Koroth Raghuprasad, Odessa, TX (US)

( * ) Notice: Subject to any disclaimer, the term of this patent is extended or adjusted under 35 U.S.C. 154(b) by 534 days.

(21) Appl. No.: 12/145,721

(22) Filed: Jun. 25, 2008

(65) Prior Publication Data

US 2009/0320189 A1 Dec. 31, 2009

(51) Int. Cl.
*A41D 13/00* (2006.01)

(52) U.S. Cl. ..... 2/69

(58) Field of Classification Search ..... 2/22, 24, 2/69, 159, 79, 227, 455, 62, 242, 400
See application file for complete search history.

(56) References Cited

U.S. PATENT DOCUMENTS

| | | | | |
|---|---|---|---|---|
| 3,957,135 | A | 5/1976 | Lane | |
| 4,077,064 | A * | 3/1978 | Maidon | 2/456 |
| 4,156,294 | A * | 5/1979 | Horn | 2/400 |
| 4,986,548 | A | 1/1991 | Conner | |
| 5,097,925 | A | 3/1992 | Walker | |
| 5,184,696 | A * | 2/1993 | Meed et al. | 182/9 |
| 5,500,956 | A * | 3/1996 | Schulkin et al. | 2/161.1 |
| 6,216,276 | B1 * | 4/2001 | Eibert | 2/161.2 |
| 6,223,854 | B1 * | 5/2001 | Nolz | 182/3 |
| 6,357,547 | B1 * | 3/2002 | Kellog et al. | 182/9 |
| 6,948,589 | B2 | 12/2004 | Johnson | |
| 7,117,537 | B2 * | 10/2006 | Mazzarolo | 2/69 |
| 2002/0139615 | A1 | 10/2002 | Penz | |
| 2004/0064977 | A1 | 4/2004 | McKinnon | |
| 2007/0221445 | A1 | 9/2007 | Fenger-Erickson | |

FOREIGN PATENT DOCUMENTS

| | | |
|---|---|---|
| FR | 2807669 | 10/2001 |
| JP | 09056846 | 3/1997 |
| JP | 2006194061 | 7/2006 |
| JP | 2006239183 | 9/2006 |
| JP | 2006288370 | 10/2006 |
| WO | 9959682 | 11/1999 |
| WO | 2006101278 | 9/2006 |

* cited by examiner

*Primary Examiner* — Tejash Patel
(74) *Attorney, Agent, or Firm* — David L King

(57) ABSTRACT

A tree climbing suit 10 formed as a one-piece suit has a long-sleeved upper torso portion 12 and a lower torso portion 22. The long-sleeved upper torso portion 12 has two long sleeves 14 for covering the arms and a shirt portion 16 for covering the chest region. The lower torso portion 22 covers the waist region and has a pair of pant legs 24 for covering the leg portion of the wearer 2. The tree climbing suit 10 has a plurality of tree contacting gripping patches 30, 32, 34, 36, 38 sewn or otherwise affixed to the suit in locations for gripping a tree. The tree-gripping patches are located at least on the regions that are in direct contact with the tree when attempting to climb it. The tree-gripping patches 30, 32, 34 are respectively located at least on portions of the long-sleeves 14, in the chest region on the shirt portion 16, and the inseams 25 of the pant legs 24 preferably extending from pant leg 24 to pant leg 24 traversing across the crotch region of the inseam 25.

14 Claims, 4 Drawing Sheets

TREE CLIMBING SUIT

TECHNICAL FIELD

The present invention relates to a device to facilitate tree climbing generally, more particularly the device is an article of clothing with provisions to improve a tree climber's grip as he or she climbs up and down trees.

BACKGROUND OF THE INVENTION

In tree climbing the degree of difficulty of climbing is often dependent on grabbing branches or limbs to pull oneself up and using the limbs to provide footing as one progresses upwardly. Similarly these features of the tree make climbing relatively easy. Many trees fall into this category and are not difficult to climb. Other trees present much more difficulty to climb in that the branches are often at heights of 20-40 feet as in the case of pine trees grown for lumber, but generally these trees are not climbed unless being removed in an urban setting to prevent the tree from falling on a structure. In these situations, the tree cutter either uses a lift machine to access the parts of the tree where he can tie the tree off in sections as he cuts and lowers the limbs to the ground or in some cases the cutter uses shoes with spikes attached to assist climbing and a harness belt attached at the waist and wrapped around the tree to help hold the climber as he works cutting the upper limbs and lowering them by ropes to the ground. These spiked shoes can tear pieces of bark from the tree, but in a tree removal effort, the damage to the bark is not relevant.

In other applications, large coconut palm trees have the palm fronds and coconuts growing at the very tops of the trees. The coconuts weigh several pounds and when ripe fall from these trees. Again in urban regions falling coconuts can be dangerous. In other situations it is desirable to harvest these coconuts and tree climbers with a machete or large cutting device must climb the palm tree to harvest the coconuts. Other types of palm trees provide similar issues.

In these cases the climber needs to get to the fruit or leaves, then cut down and do so in a safe reliable way that does not damage the tree.

Numerous injuries and even deaths have occurred climbing coconut palm trees. Natives in many regions harvesting the coconuts have learned to shimmy up these trees using bare feet and a loop of thick cord to hold the feet tethered and their arms to work their way to the top. Some skilled climbers do this all day harvesting the crop.

Ideally, the efficiency of climbing could be improved if the tree climbers could use less exertion when climbing; then productivity could be improved.

Even more importantly, if the climber was less fatigued, he or she would be less prone to death or injuries due to falling.

It is therefore an object of the present invention to provide a cost-efficient article of clothing that facilitates tree climbing.

SUMMARY OF THE INVENTION

A tree climbing suit formed as a one-piece suit has a long-sleeved upper torso portion and a lower torso portion. The long-sleeved upper torso portion has two long sleeves for covering the arms and a shirt portion for covering the chest region. The lower torso portion covers the waist region and has a pair of pant legs for covering the legs of the wearer. The tree climbing suit has a plurality of tree contacting gripping patches sewn or otherwise affixed to the suit in locations for gripping a tree.

The tree-gripping patches are located at least on the regions that can come into direct contact with the tree when attempting to climb it. The tree-gripping patches are located at least on forearm portions of the long-sleeves, the inseams of the pant legs preferably extending from one pant leg to the other pant leg traversing across the crotch region of the inseam and in the chest region on the shirt portion.

The tree climbing suit additionally may have a safety belt harness affixed around the waist portion and having one or more adjustable length straps, each strap being connectible to an attachment means on the suit or another strap to form a loop around the tree.

In addition, at the end of the pant legs a pair of foot holsters are provided, one foot holster attached to each leg end to form a loop for wrapping around a sole of the foot or shoe (if shoes are worn) of a wearer. The foot holsters prevent the pant legs from moving up the climber's leg. Preferably, the foot holsters cover the upper foot and extend from each pant leg wrapping around the foot and have at least the insole portion having one or more gripping patches. These gripping patches preferably extend from over the ball of the foot across to the insole of the foot to the plantar surface of the foot.

In addition, each climbing suit will have a pair of fingerless palm covers, one fingerless palm cover extending from each sleeve portion for covering the wearer's hand. Each palm portion has a gripping patch in the region of the palm to facilitate climbing a tree.

Preferably the tree climbing suit is made of a woven material and is very durable. Such material can be made of nylon or denim or any other suitable material, preferable of a lightweight, airy or of a sweat absorbing nature so as not to impede tree climbing.

In a preferred embodiment the gripping patches are made of Velcro hooks wherein the hooks are preferably oriented to support a hanging load and released upon any upward climbing force. Alternatively the gripping patches can be made from a synthetic elastomeric material or natural rubber material. In the case where the gripping patches are made of an elastomeric or natural rubber material, each gripping patch can either have a plurality of gripping ridges for supporting a load or the gripping patches can have the synthetic material made of a plurality of rubber-like bristles for supporting a load.

In certain portions of the tree climbing suit the gripping patches may further include a cushion pad interposed between the suit material and the gripping patch. This cushion material provides protection for the wearer and additional conformity of the gripping patch such that it will conform around the tree in such a fashion to provide additional gripping surface. This cushion pad can be made of any suitable padding material such as cotton, rubber or urethane.

DETAILED DESCRIPTION OF THE INVENTION

Figure 1:
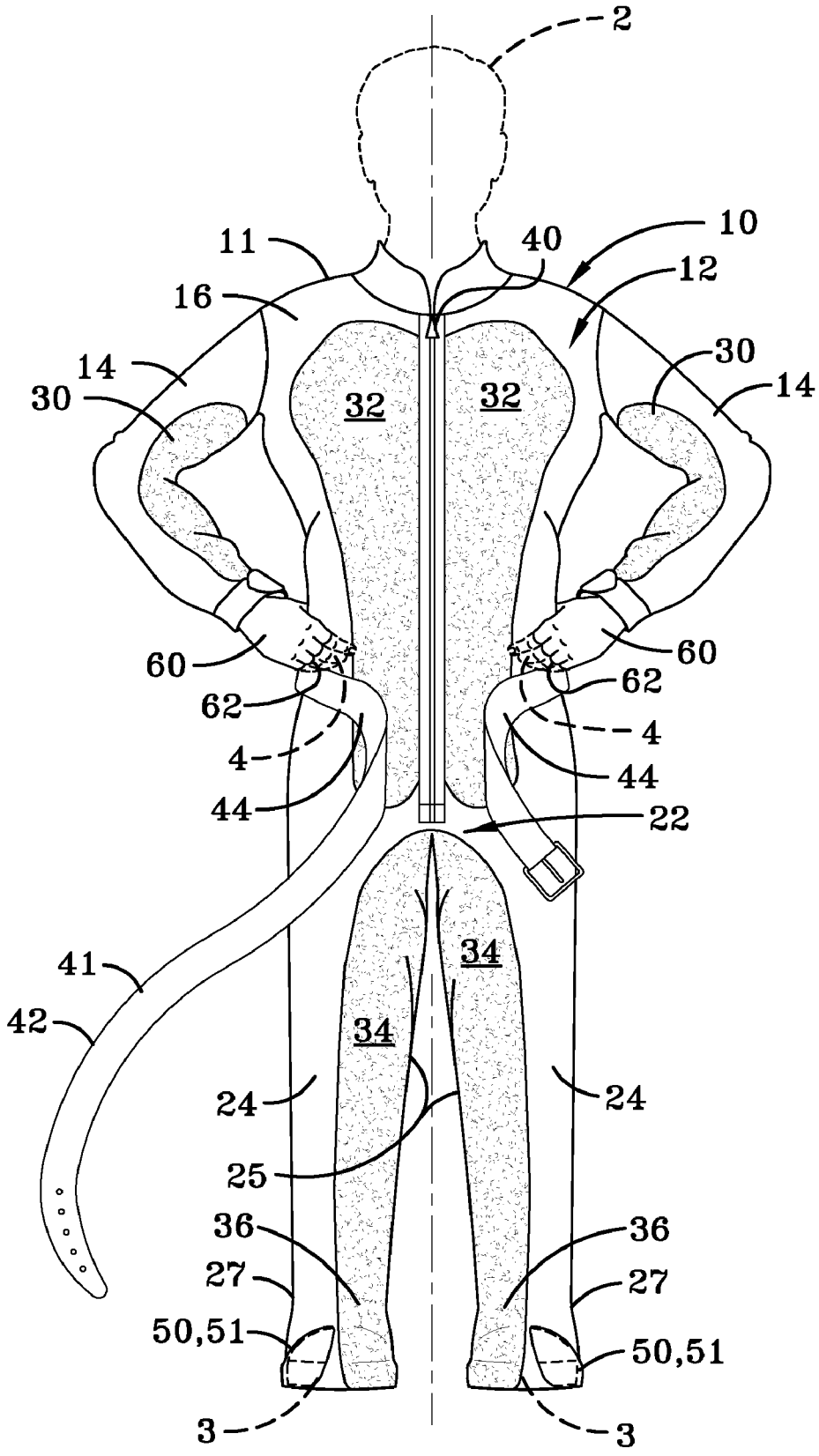
FIG. 1 is a front view of the tree climbing suit with the wearer's head shown in phantom lines.

With reference to FIG. 1, the one piece tree climbing suit 10 is shown in a frontal view, the head of the wearer 2 is illustrated in dashed lines and the suit 10 is illustrated in solid lines. The suit 10 as shown preferably has a frontal zipper 40 that allows the wearer 2 to put the clothing on and off as desired. As shown, the suit 10 has an upper torso portion 12 that includes a pair of long-sleeves 14 and a shirt portion 16 that covers the chest and back area of the wearer 2. The upper torso portion 12 is then joined by a lower torso portion 22 that covers the waist region of the wearer 2 and has two lower pant legs 24 extending from the waist region down to the feet. As shown, the one piece tree climbing suit 10 has a plurality of gripping patches 30, 32, 34, 36 sewn directly onto the suit 10. Each gripping patch is preferably located along areas in which an individual climbing a tree would have these surfaces in direct contact with the tree as he attempts to make his climb. One must appreciate in the method of climbing a tree wherein there are no branches, as the person grasps around the tree and wraps his legs around the tree and tends to move upwardly by pulling the legs upward while grasping onto the tree, clinching onto the tree then moving his upper body upward in a zig zag action. This movement back and forth enables the climber to traverse the tree to the top of the tree; the reverse of this procedure is used when coming down. In doing so the arms are generally wrapped around the tree and the legs are similarly straddling the tree and providing some gripping action to help hold the climber as he climbs.

As shown in FIG. 1, a belt harness 42 having one or more straps 44 is attached to the suit 10 such that the belt harness 42 extends from the waist area with a long strap 44 that can be connected back to the suit 10 or to another additional strap 44 in such a way that a loop can be formed around the tree. This belt harness 42 and strap 44 combination enables the wearer 2 to create his own safety harness as he climbs, preferably the loop is sufficiently long to provide a bit of the gap between the tree and the wearer 2 of the suit 10. In this condition it gives enough freedom or slack between the safety belt harness 42 and the wearer 2 such that he can freely climb up and down the tree and should he slip, the belt will act as a safety harness, as he falls the belt harness 42 itself can grip onto the tree.

Figure 2:
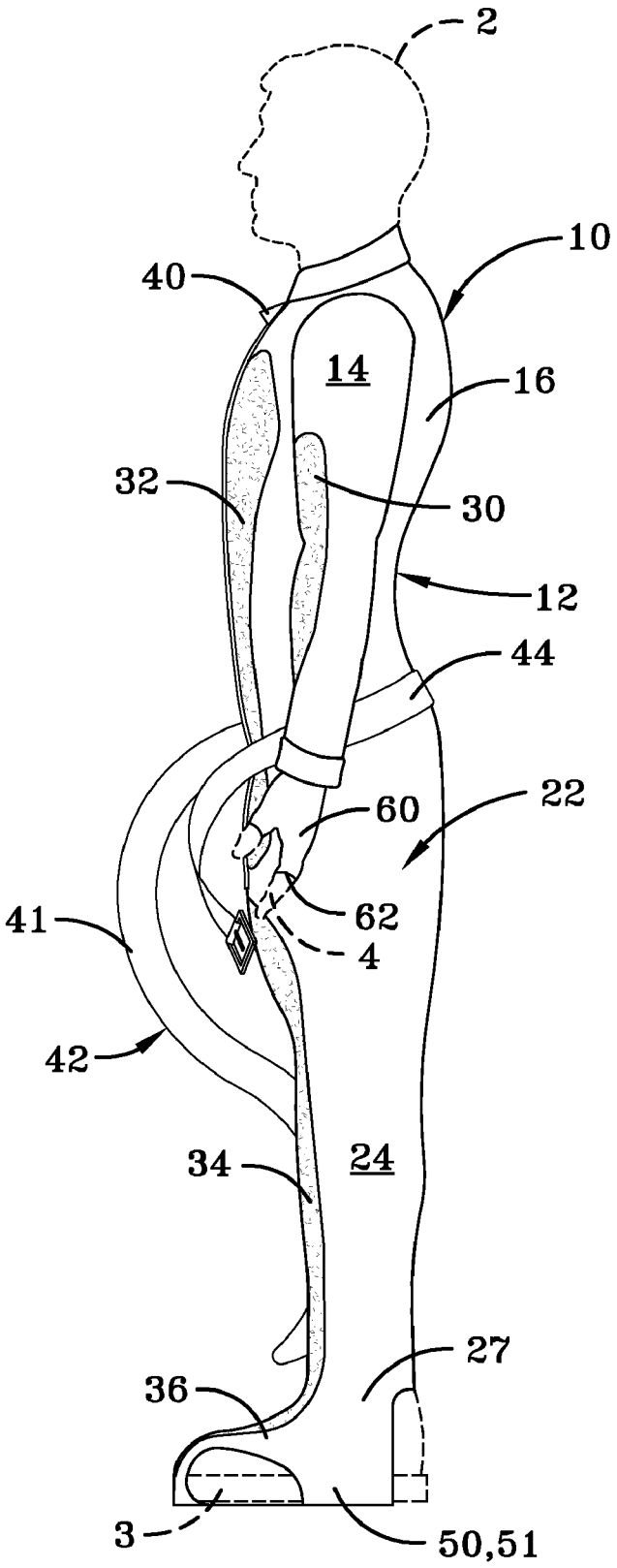
FIG. 2 is a side view of the tree climbing suit taken from FIG. 1.

As shown in FIGS. 1 and 2, the patches 30 preferably are provided along the forearms on the inner portion of the sleeve 14 such that as the arms are wrapped around the tree, the gripping patches 30 make direct contact with the tree. These are provided from the wrist preferably up to the armpit area. Additionally the shirt portion 16 of the upper torso portion 12 of the suit 10 is provided with one or more frontal gripping patches 32, the gripping patch 32 may be separated by the zipper 40 such that it is two patch pieces that form a gripping patch 32 along the chest area between the waist and the upper torso. Preferably the gripping patches 32 may extend further down the waist to provide even more additional support if so desired.

Figure 3:
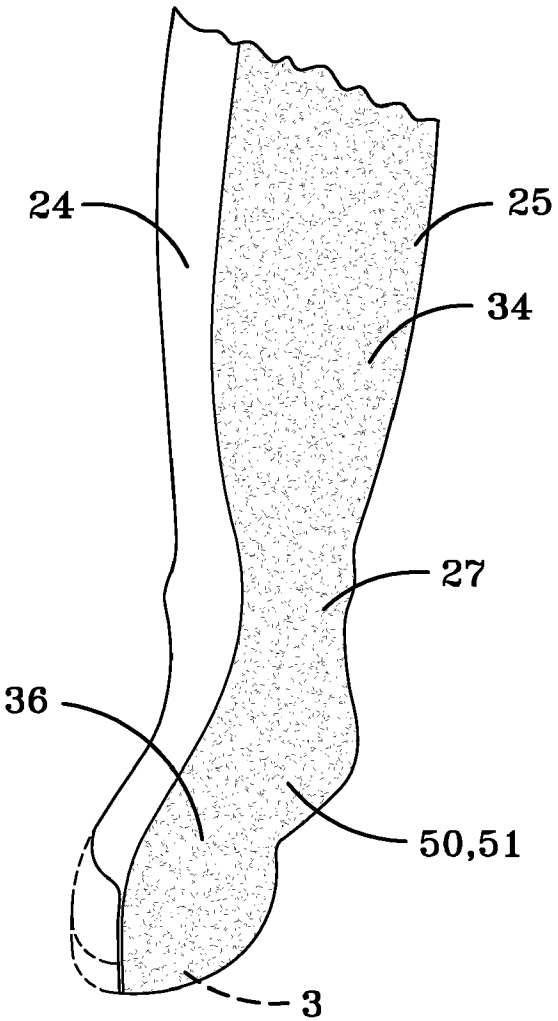
FIG. 3 is an illustration of a portion of one leg inseam of the tree climbing suit pant leg.

With reference to FIG. 3, a lower portion pant legs 24 of the suit 10 is illustrated, within the leg region of the suit 10 preferably the entire inseam 25, as shown in FIG. 1, is provided with one or more gripping patches 34. As illustrated in FIG. 1, the inseam 25 can preferably extend from the foot area of the pant leg 24 all the way across the inseam crotch area and down the other inseam 25 to the other foot. In this way, as the wearer 2 climbs, he can wrap his legs around the tree and provide additional gripping action.

As shown in FIGS. 1, 2 and 3, each pant leg 24 has a foot holster 50 integral to or otherwise sewn directly at the end 27 of the pant leg 24 and extending from one side of the pant leg 24 to the other side of the pant leg 24 forming a loop 51 wherein the foot 3 is then placed inside this loop 51 and provide a means of securing the suit pant leg 24 in a secure manner such that it cannot slide up or down the wearer's leg as he climbs up or down a tree. This holster 50 preferably covers the top portion of the foot 3 as well and additionally may have and preferably does have a contact patch 36 sewn such that it covers the top portion of the foot 3 and extends down into the insole of the foot area.

Figure 4:
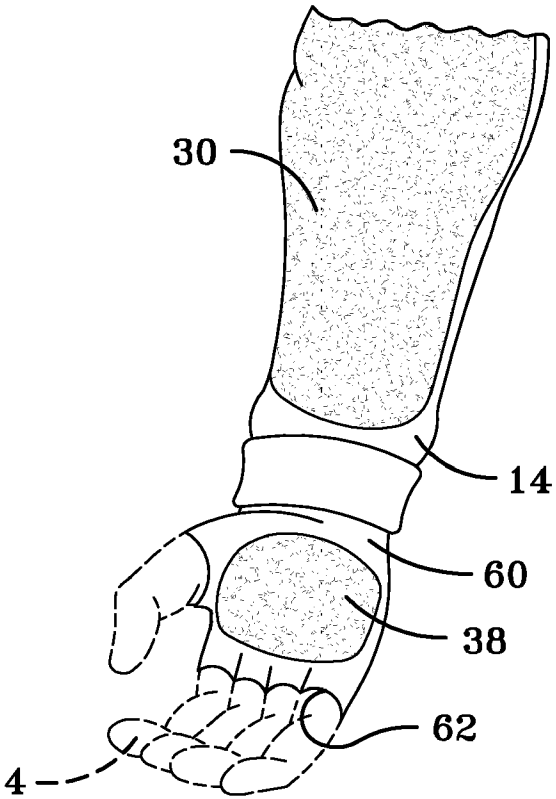
FIG. 4 is an illustration of a portion of one forearm and hand portion of the tree climbing suit.

With reference to FIG. 4, showing the long sleeves 14 of the tree climbing suit 10 as previously discussed, the inner portion of the sleeves 14 have a contact gripping patch 30 such that the arms can wrap around a tree. In addition, fingerless palm grips 60 are provided such that the hands 4 can be inserted through the sleeve 14 of the suit 10 into the fingerless palm grips 60 such that the fingers can extend through openings 62 provided in the palm grips 60 allowing the fingers to be free and not covered within a glove or mitt. However, in the palm region a gripping patch 38 is provided to afford additional gripping support in a climb and to provide some protection to the hands as they grip onto the tree.

These features greatly facilitate the tree climber's ability to ascend or descend trees without the fear of slipping. The gripping patches provide additional adhesion to the tree climber such that he can rest and support his weight while climbing a tree.

Figure 6A:
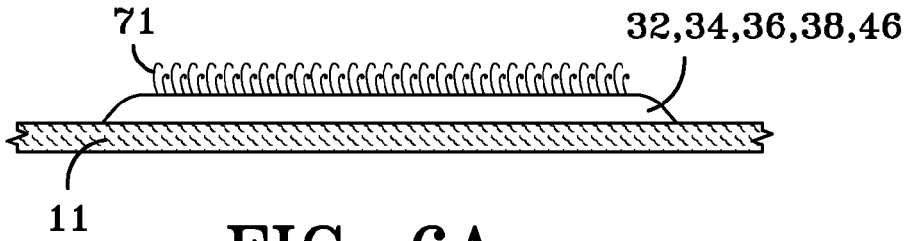
FIGS. 6A, 6B and 6C show various gripping patches for attachment to the tree climbing suit.

As shown, the tree climbing suit 10 is preferably made of a heavy duty woven material 11 such as nylon, tightly woven cotton, lightweight synthetic, or denim material with the back more open to allow the free flow of air to prevent overheating. Ideally, the suit 10 is lightweight enough so it does not encumber the tree climber, but provides sufficient assistance by providing the gripping patches 30 through 38 as previously discussed. With regard to the gripping patches 30 through 38, they can be made of Velcro type hooks 71, as shown in FIG. 6A, preferably all oriented in such a direction that the hooks 71 tend to grasp onto the tree bark in such a fashion that they will support a load and upon an upward force immediately release without creating any resistance for the wearer 2. Accordingly, the open end of each hook 71 is preferably orienting downwardly relative to the vertical extent of a tree when climbing. This is important in that the gripping action preferably does hot impede climbing, but only assists in supporting the weight of the wearer 2.

Figure 5:
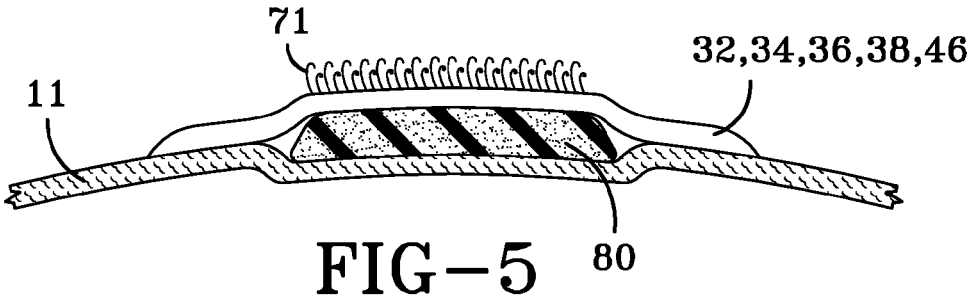
FIG. 5 is a cross sectional view of the gripping patch and the tree climbing suit with a cushion pad interposed.

With further reference to the contact patch 30 through 38 as shown in FIG. 5, a cross sectional view shows that between the suit material 11 and the contact patch can be provided a cushioning pad 80. The cushioning pad 80 provides additional protection to the wearer 2 and prevents localized abrasion that could otherwise occur due to climbing. This cushioning pad 80 can be made of a thick cotton batting material or can be made out of an elastomeric or rubber material that is sewn between the two layers such that it provides sufficient cushioning without impeding the wearer 2.

Figure 6B:
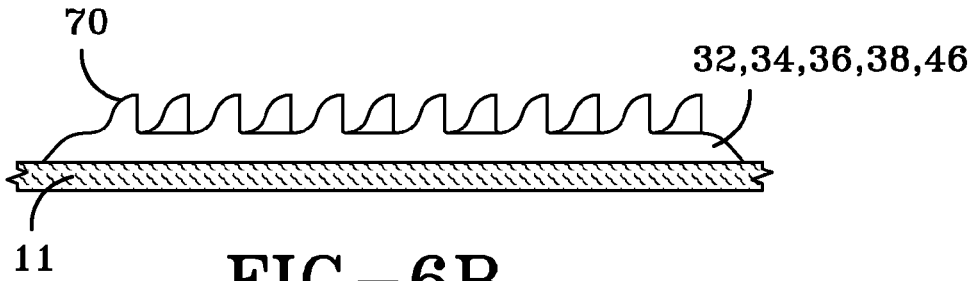
Figure 6C:
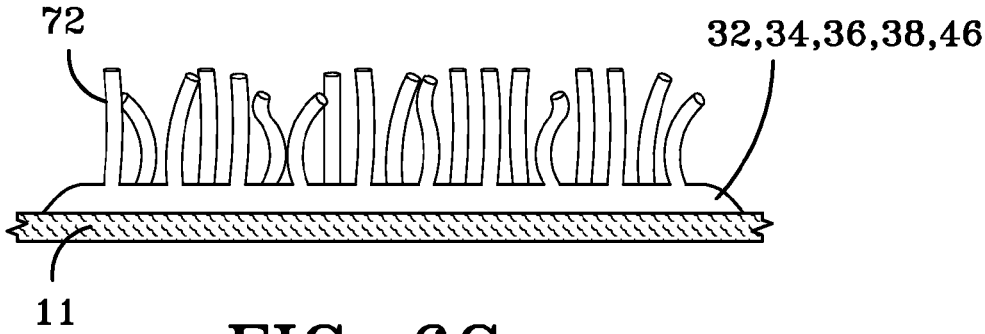

In an alternative embodiment, shown in FIG. 6B, the gripping patch 30 through 38 itself may be made of a rubber or elastomeric type material wherein the patch is provided with a plurality of ridges 70 that provide additional support for the wearer 2 as he climbs the tree. As shown, these ridges 70 are preferably oriented in a direction that creates an "s" shaped edge in the downward facing direction relative to a tree and rounded upwardly for quick release as the wearer climbs and helps support the load as the individual is climbing. Alternatively, as shown in FIG. 6C, an elastomeric or rubberized material can be provided with a plurality of hair-like bristles 72 in each contact patch 30 through 38. The bristles 72 provide surfaces that readily contact into the tree and provide additional adhesion. As shown, each contact patch is preferably sewn or otherwise permanently affixed to the one piece suit in such a fashion that it cannot easily be torn away.

These and other features as described and with some practice, greatly facilitate the ability of the suit wearer 2 to climb a tree and to function. As shown, the suit 10 provides a fingerless palm grip 60 such that the wearer 2 can fully function once climbed to the top of the tree where he may withdraw his knife or machete and continue to remove coconuts or other items or whatever function is required for the climber once he reaches the top. Once his mission is accomplished he can then descend down the tree very safety and quickly using the belt harness 42 to assist the procedure of reversing his climbing technique to allow him to descend from the tree in a rather safe and efficient manner.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is therefore, to be understood that changes can be made in the particular embodiments described which will be within the full intended scope of the invention as defined by the following appended claims.

I claim:

1. A tree climbing suit formed as a one-piece suit comprises:

an upper torso portion having two long-sleeves for covering the arms and a shirt portion for covering the chest region;

a lower torso portion covering the waist and legs of the wearer; the lower torso portion having two pant leg portions; and a plurality of tree contacting gripping patches sewn or otherwise affixed to a exterior surface of the suit on the upper torso portion or lower torso portion or both upper and lower portions for gripping the tree, and a pair of foot holsters, one of the pair of foot holsters attached to each leg end to form a loop for wrapping around a sole of a foot, the pair of foot holsters prevent the pant legs from moving up the climber's leg, wherein each one of the pair foot holsters covers the upper foot and extends from each of the pant leg and at least each upper foot portion having a gripping patch.

2. The tree climbing suit of claim 1 wherein the tree-gripping patches are located at least on forearm portions of the long sleeves.

3. The tree climbing suit of claim 1 wherein the tree-gripping patches are located at least on inseams of the pant legs.

4. The tree climbing suit of claim 1 wherein the tree-gripping patches are located at least on the shirt portion on the chest region.

5. The tree climbing suit of claim 1 further comprises:

a safety belt harness affixed around the waist portion and having one or more adjustable length straps, each strap having an attachment means connected to the suit or another strap on the suit to form a loop around a tree, the safety belt harness having an inside surface with gripping patches attached.

6. The tree climbing suit of claim 2 further comprises:

a pair of fingerless palm covers, one fingerless palm cover extending from each sleeve for covering the hand, each palm cover having a gripping patch in the region of the palm.

7. The tree climbing suit of claim 1 wherein the suit is made of a woven material.

8. The tree climbing suit of claim 7 wherein the tree climbing suit is made of nylon, synthetic material or denim or other closely woven material.

9. The tree climbing suit of claim 1 wherein the plurality of gripping patches are made of hook and loop material.

10. The tree climbing suit of claim 1 wherein the hooks of the hook and loop material are oriented to support a hanging load and released upon an upward climbing force.

11. The tree climbing suit of claim 1 wherein the gripping patches are made from a synthetic elastomeric material or natural rubber.

12. The tree climbing suit of claim 11 wherein the plurality of gripping patches each has a plurality of gripping ridges for supporting a load.

13. The tree climbing suit of claim 11 wherein the plurality of gripping patches each has a plurality of rubber-like bristles for supporting a load.

14. The tree climbing suit of claim 12 wherein the plurality of gripping patches include an underlying cushion pad interposed between the suit and the gripping patch.

* * * * *